US007957978B2

(12) United States Patent
Bauer et al.

(10) Patent No.: US 7,957,978 B2
(45) Date of Patent: Jun. 7, 2011

(54) METHOD AND TERMINAL FOR ENCODING OR DECODING AN ANALOG SIGNAL

(75) Inventors: Wolfgang Bauer, Vienna (AT); Stefan Schandl, Vienna (AT)

(73) Assignee: Siemens Aktiengesellschaft, Munich (DE)

( * ) Notice: Subject to any disclaimer, the term of this patent is extended or adjusted under 35 U.S.C. 154(b) by 885 days.

(21) Appl. No.: 11/794,790

(22) PCT Filed: Dec. 5, 2005

(86) PCT No.: PCT/EP2005/056479

§ 371 (c)(1),
(2), (4) Date: Jul. 3, 2007

(87) PCT Pub. No.: WO2006/072519

PCT Pub. Date: Jul. 13, 2006

(65) Prior Publication Data

US 2009/0276226 A1 Nov. 5, 2009

(30) Foreign Application Priority Data

Jan. 5, 2005 (DE) ..... 10 2005 000 828

(51) Int. Cl.
*G10L 21/00* (2006.01)

(52) U.S. Cl. ..... 704/500

(58) Field of Classification Search ..... 704/500
See application file for complete search history.

(56) References Cited

U.S. PATENT DOCUMENTS 6,073,092 A * 6/2000 Kwon ..... 704/219
6,173,257 B1 1/2001 Gao
6,795,805 B1 9/2004 Bessette et al.
7,039,581 B1 * 5/2006 Stachurski et al. ..... 704/205
7,139,700 B1 * 11/2006 Stachurski et al. ..... 704/207
7,222,070 B1 * 5/2007 Stachurski et al. ..... 704/207

FOREIGN PATENT DOCUMENTS

DE 693 22 313 T2 12/1993
DE 695 26 017 T2 4/1996
DE 696 13 910 T2 12/1996
WO WO 02/33832 A1 4/2002
WO WO 02/095734 A2 11/2002

OTHER PUBLICATIONS

Marques J. S. et al: "Improved pitch prediction with fractional delays in CELP coding" Proceedings of ICASSP 1990, Apr. 3, 1990, pp. 665-668, XP010642016.

Marques J. S. et al, Tubach J. P. et al: "Pitch prediction with fractional delays in CELP coding" Proceedings of the European Conference on Speech Communication and Technology (Eurospeech), Conf. 1, Paris, Sep. 26-28, 1989, Edinburgh, CEP Consultants, GB, Sep. 1, 1989, pp. 509-512, vol. 2, XP000214278.

* cited by examiner

*Primary Examiner* — Susan McFadden

(57) ABSTRACT

An analog signal divided into time frames is encoded and a synthetic signal is formed on the model thereof in a time frame manner via a synthesis filter which is excited by an excitation signal. The excitation signal is formed by at least one adaptive code list containing a plurality of scanning values provided with a defined scanning space. For the actual excitation signal, a segment corresponding to the time frame length is selected from the plurality of scanning values via a speech-based frequency parameter which can take non-integer values and, in such a case, the values intermediate to the scanning values defined by the speech-based frequency parameter are formed in such a way that the time space between the intermediate values and the scanning values is reduced and the totality of the intermediate and the scanning values is used for forming the excitation signal.

12 Claims, 4 Drawing Sheets

METHOD AND TERMINAL FOR ENCODING OR DECODING AN ANALOG SIGNAL

CROSS REFERENCE TO RELATED APPLICATIONS

This application is the US National Stage of International Application No. PCT/EP2005/056479, filed Dec. 5, 2005 and claims the benefit thereof. The International Application claims the benefits of German application No. 102005000828.3 DE filed Jan. 5, 2005, both of the applications are incorporated by reference herein in their entirety.

FIELD OF INVENTION

The invention relates to a method for encoding an analog signal by means of an analysis based on synthesis methods.

BACKGROUND OF THE INVENTION

A topic much discussed at the present time is the idea of expanding the bandwidth for acoustic signals, e.g. expanding from 4 kHz telephony bandwidth to 8 kHz broadband telephony, since this will be accompanied by a significant improvement in the quality of the voice signal.

However, bandwidth is a limited resource, in particular in mobile cellular communications, in which at least a part of the transmission takes place over a radio link. That is to say that the predefined, limited bandwidth has to be distributed among a plurality of users. If the bandwidth is then increased for one user, it necessarily follows, assuming the number of users remains the same, that the bandwidth available to the remaining users will be reduced.

SUMMARY OF INVENTION

Various methods are therefore applied in order to construct from the excitation signal in the narrowband, i.e. for example with a 4 kHz bandwidth in the range from 0 to 4 kHz, a signal of higher bandwidth, for example 8 kHz bandwidth from 0 to 8 kHz.

This is accomplished for example by squaring the narrowband signal in the time domain and generating the missing band by mirroring or shifting the narrowband in the frequency domain. For the example of the 4 kHz bandwidth and a desired bandwidth of 8 kHz, this means that the spectrum from 0 to 4 kHz is mirrored at, for example, 4 kHz, thereby generating the spectrum from 4 to 8 kHz. Alternatively a shifting by 4 kHz is possible. By means of these methods a broadband signal can thus be constructed from a narrowband signal, albeit with the resulting disadvantage that these methods either distort the spectrum of the narrowband excitation signal or else cause data errors in the spectrum.

Proceeding from the basis of this prior art, the object of the present invention is to provide a means of creating a signal that is of high quality compared to the prior art while at the same time requiring only a small amount of transmission bandwidth.

This object is achieved by the independent claims. Advantageous developments are the subject matter of the dependent claims.

An analog signal is broken down into time frames for encoding purposes and a synthetically produced signal is matched to the analog signal time frame by time frame. The synthetic signal is generated as the output signal of a synthesis filter which is excited by means of an excitation signal as input signal.

In order to form the excitation signal use is made of at least one adaptive codebook which contains the excitation signal for earlier time frames. The earlier excitation signal is represented in this case as a plurality of sampled values.

In order to represent the current excitation signal, a segment corresponding to the length of the current time frame is selected from the plurality of sampled values contained in the adaptive codebook. The selection is made using a reference parameter which is dependent on a basic voice frequency and which can also assume non-integer values, i.e. points to locations for intermediate values lying between the actually present sampled values.

If the basic voice frequency parameter now assumes a non-integer value, intermediate values corresponding to the sampled values are chosen in the selected segment. As already described, the segment corresponds in its length to the current time frame and its position in the adaptive codebook is specified by the basic voice frequency parameter.

This forming of intermediate values is accomplished for example by means of interpolation. An interpolation can be performed in particular by means of a (sin x)/x function.

The core of the invention is thus to use the totality of sampled values and interpolation values for forming the excitation signal.

This has the advantage that an effective higher bandwidth is achieved which is produced from the effectively higher sampling rate for the sampled values and intermediate values. This enables the quality of a synthetic signal reproduced on the receiver side and corresponding as closely as possible to the actual analog signal to be considerably improved. This improvement happens without an increase in the demand for transmission bandwidth, since the same encoding parameters are transmitted as in the case of a narrowband solution.

The improvement is achieved in that already generated intermediate values in the codebook—in particular on the transmitter and receiver side—are retained and used to generate the excitation signal.

This is in contrast to prior art solutions in which, despite the fact that a non-integer basic voice frequency parameter was provided which specified the position of the segment in the adaptive codebook, the interval between the intermediate values used for generating the excitation signal was not reduced.

To express it in different words, if, for example, the basic voice frequency parameter specifies the start of the selected segment and points to the value 5⅓, the corresponding intermediate values 5⅓, 6⅓, 7⅓ etc. are formed and only these are used for generating the excitation signal and retained in the adaptive codebook. According to the invention, however, the values 5⅓, 5⅔, 6, 6⅓, 6⅔ etc. would be used, which can be accomplished without additional transmission of information. In this way an improvement in quality is produced while at the same time achieving an efficient utilization of transmission capacity.

In particular the basic voice frequency parameter can be represented as a fraction of a whole number N. This then results in a reduction in the time interval by 1/N. If, for example, N=2 or 3 is chosen, which corresponds to a doubling or tripling of the bandwidth of the excitation signal to be represented, the interval reduces between a sampled value and an intermediate value to ½ or ⅓. Similarly, in the case where N is greater than or equal to 3, the interval between two intermediate values is reduced to the same value.

The excitation signal can also be generated in particular by means of a fixed codebook. Fixed excitation signals, for example, are contained in a fixed codebook.

According to an advantageous embodiment it is provided to retain the fixed codebook in its originally specified bandwidth or, as the case may be, the original sampled values and to achieve a higher bandwidth only by means of the adaptive codebook. This has the advantage of a particularly simple implementation.

In order to create intermediate values between the originally present fixed excitation signals also in the case of the fixed codebook, a fixed codebook entry can be shifted while retaining the time intervals between the signal components. If, for example, a fixed codebook entry of length 4 has a signal component at times 1 and 3, and no signal component or a zero value of the signal component at times 0, 2 and 4, then a shift would take place to the times ⅓ to 4⅓.

Alternatively it can be provided to determine intermediate values by interpolation in the case of the fixed codebook also.

In addition or alternatively to the fixed codebook, a white, i.e. essentially frequency-independent, noise signal can be used for generating the excitation signal. This can save on the need for the fixed codebook, for example. Experience has shown that in this way, in particular with voice signals, a very satisfactory quality of the signal generated on the receiver side can be guaranteed.

The noise signal is recorded from the environment or generated by means of a noise generator.

In order, for example, to avoid an overemphasizing of the harmonic structure in the thus expanded frequency range, that is to say, for example, the frequency range between 4 and 8 KHz in the case of a narrowband signal with a 4 kHz bandwidth, a filtering of the formed excitation signal can be provided, in particular before it is used as an input signal for the synthesis filter. Wiener FIR (Finite Impulse Response) filtering, for example, can be performed in this case.

The proposed methods can be performed in a communication terminal device having an encoding unit, such as, for example, a mobile phone, a PDA (Personal Digital Assistant), a computer or a fixed-network telephone, etc.

A corresponding receiver, for example interworking elements between different communication systems, a TRAU (Transmission and Rate Adaption Unit) has a corresponding decoding unit.

A suitable communication system has at least one communication terminal and one receiver.

BRIEF DESCRIPTION OF THE DRAWINGS

Further advantages are presented with reference to exemplary embodiments, some of which are also depicted in the figures, in which.

DETAILED DESCRIPTION OF INVENTION

Figure 1A:
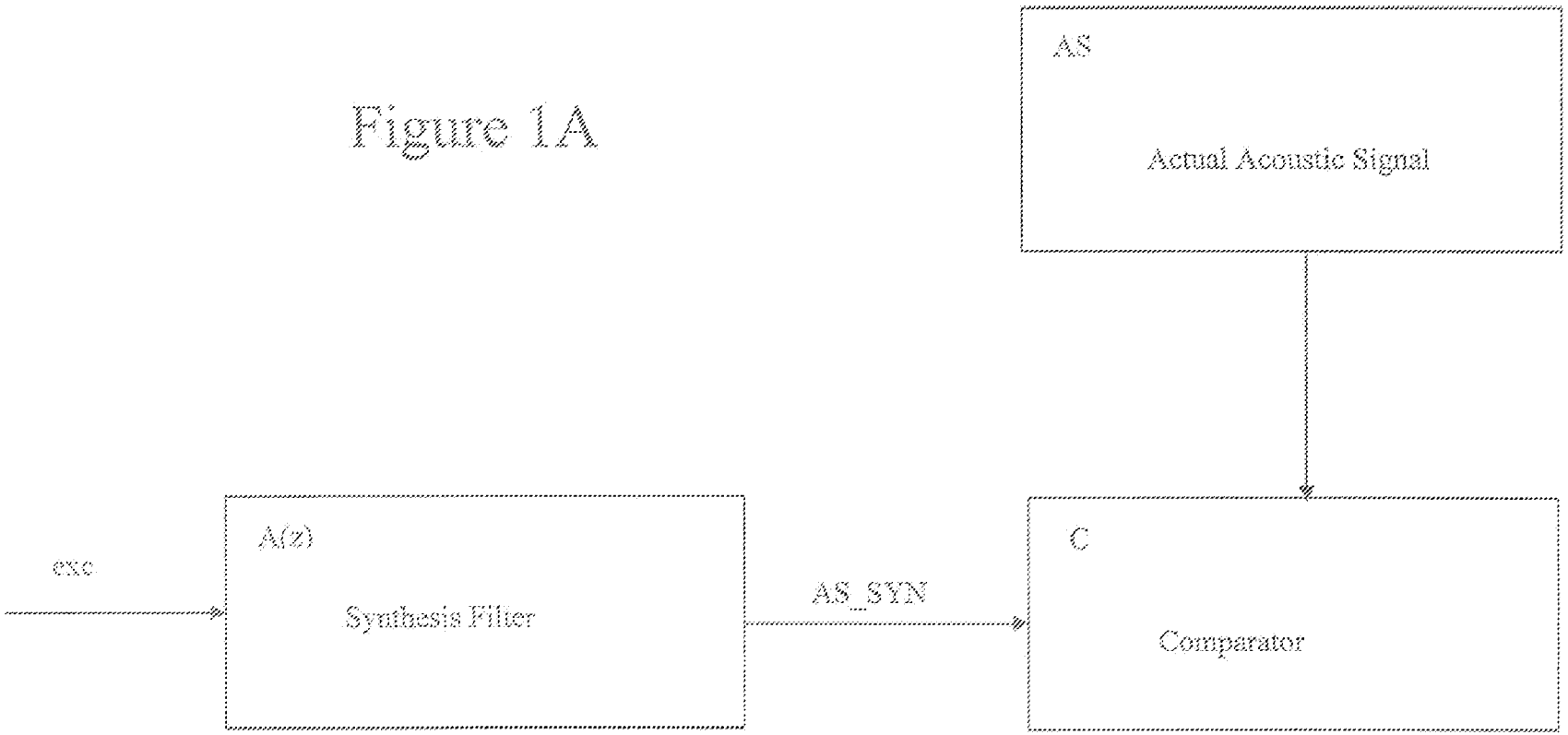
FIG. 1*a*: shows the generation of a synthesized signal.

FIG. 1*a* shows the use of an excitation signal exc for exciting a synthesis filter A(z). The synthesis filter A(z) simulates in the case of voice signals in the human vocal tract, with the result that in this case a synthetic acoustic signal AS_syn is generated by means of a suitable excitation signal exc. Said synthetic acoustic signal AS_syn is compared with the actual acoustic signal as by means of a comparator C. The excitation signal exc is successively matched in such a way that the synthetic acoustic signal AS_syn simulates the actual acoustic signal as as closely as possible.

Figure 1B:
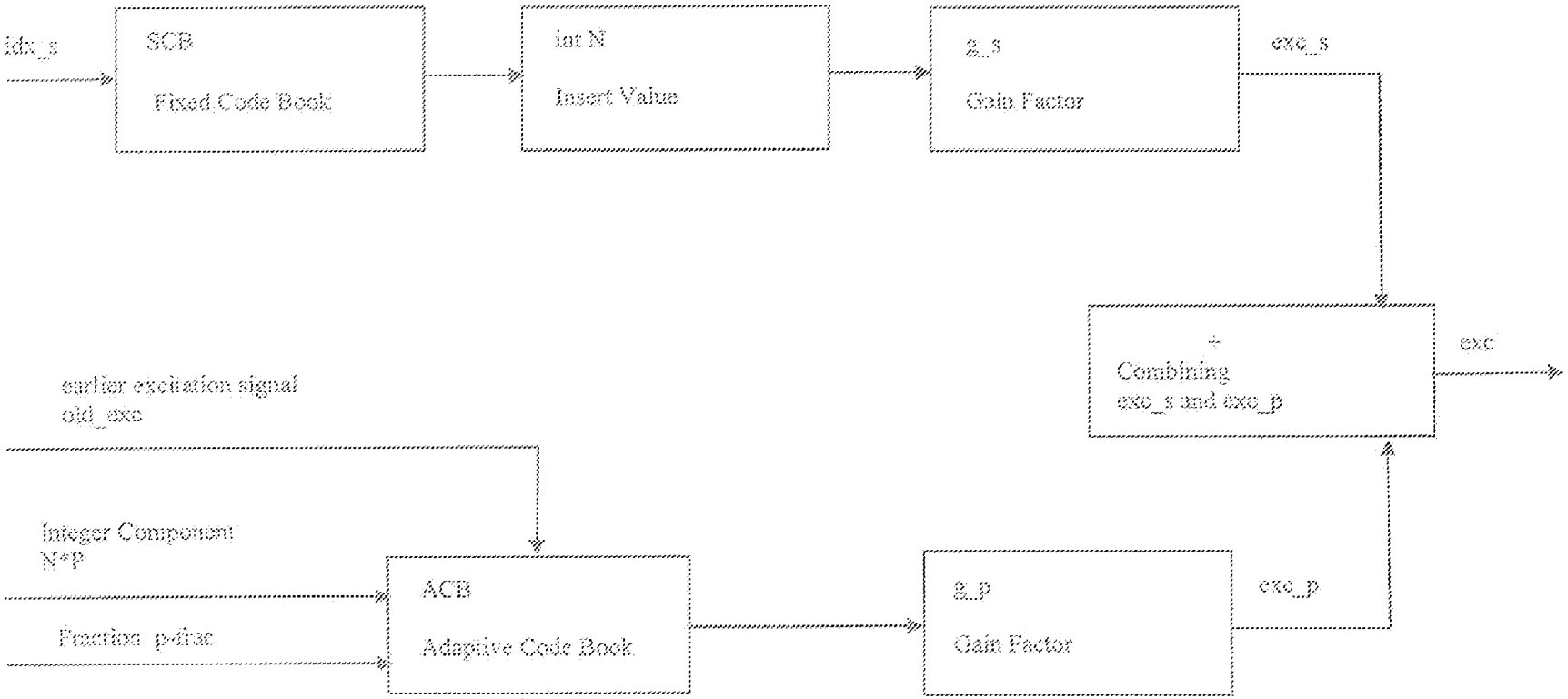
FIG. 1*b*: shows the generation of an excitation signal for a broadband solution.

FIG. 1*b* then shows the generation of the excitation signal exc. Several parameters are used for this purpose, which parameters are finally transmitted for effective use of the bandwidth, since the transmission of said parameters requires less transmission capacity than the transmission of the excitation signal exc itself.

FIG. 1*b* shows the generation of an excitation signal exc in the case of a broadband solution.

What is understood by broadband solution in this case is that the bandwidth of the signal reconstructed on the receiver side is greater than originally provided e.g. by the embodiment of codebooks. In the case of an extension of the G.729, a signal with 4 kHz bandwidth is referred to as a narrowband signal, and a signal expanded to 8 kHz bandwidth is referred to as a broadband signal.

In order to generate the excitation signal, an adaptive codebook ACB is provided by means of which harmonic components of the acoustic signal are represented. For that purpose the adaptive codebook includes earlier excitation signals old_exc, i.e. signals from preceding time frames or time slots. An entry is chosen from the adaptive codebook ACB by way of a non-integer basic voice frequency parameter p which is represented by its integer component N*(int p), where N represents an integral number, and the fraction p_frac.

Figure 2A:
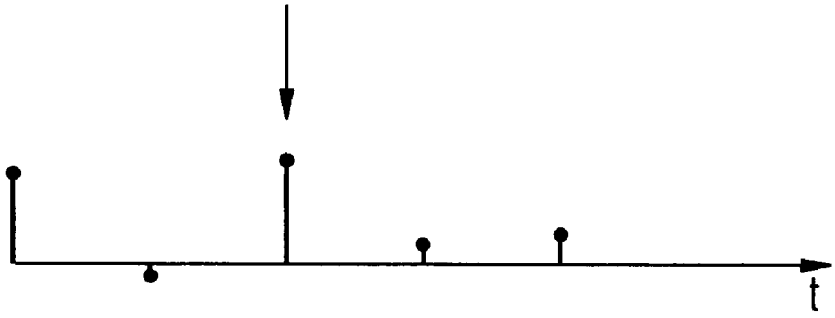
FIG. 2: shows a codebook entry from the adaptive codebook for different bandwidths.
Figure 2B:
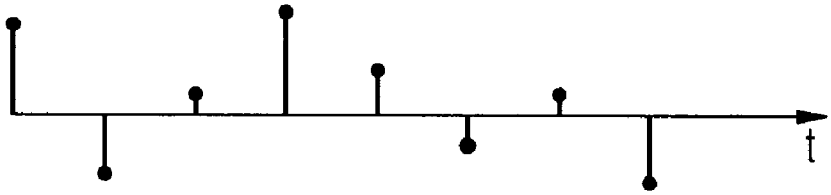
Figure 2C:
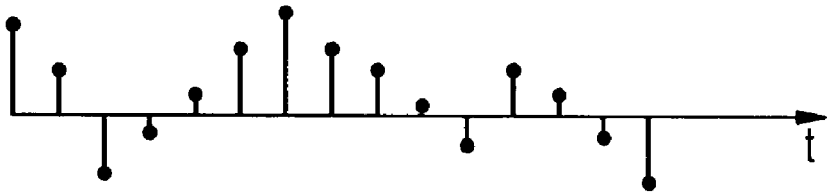
Figure 3A:
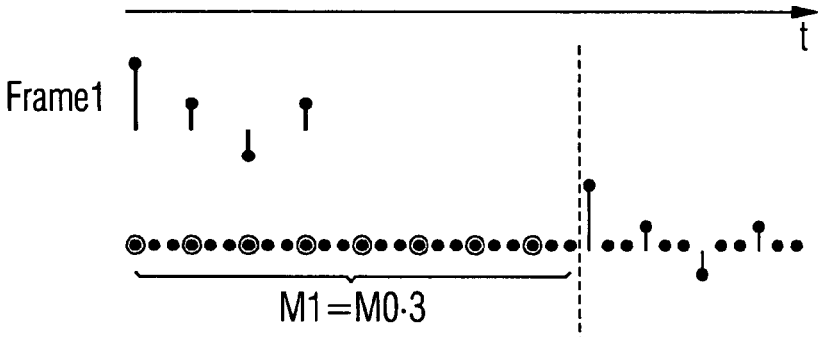
FIG. 3 shows an exemplary bandwidth expansion in the adaptive codebook.
Figure 3B:
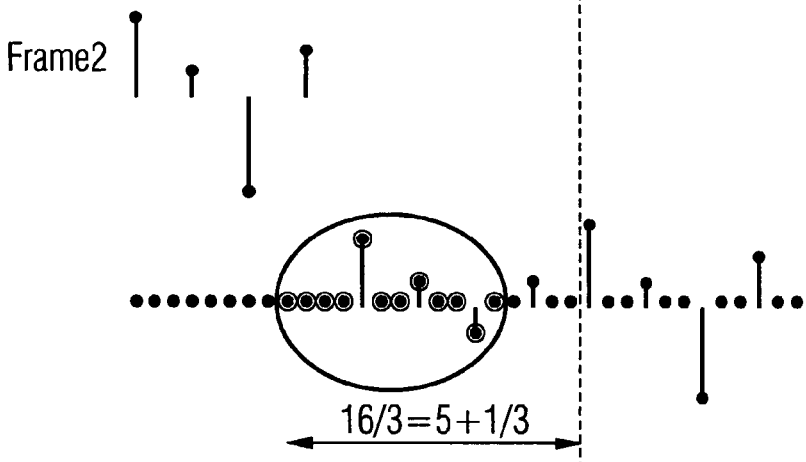
Figure 3C:
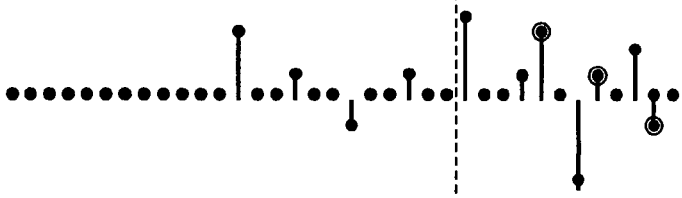
Figure 3D:
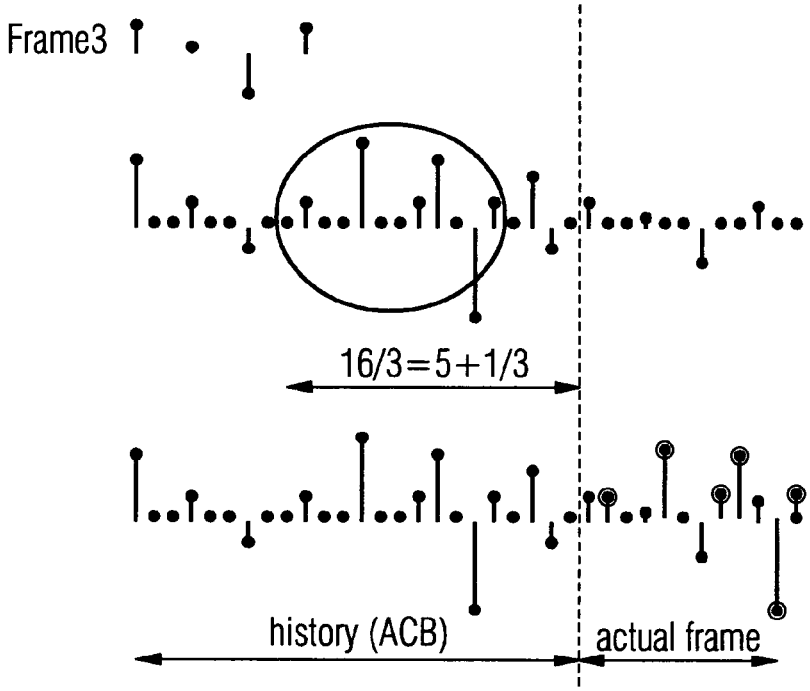

The basic voice frequency parameter in FIG. 2 is determined for example on the basis of the bandwidth in line a). In order, for example, to arrive at the $3^{rd}$ sampled value, p=3 is chosen. In order to reach this sampled value when an N-th less interval is present between sampled values or intermediate values and intermediate values, i.e. that in the adaptive codebook ACB has an N-times higher bandwidth, a value of N*p+p_frac is required.

In this case FIG. 2 shows sampled values of the excitation signal exc for different sampling rates. Depending on sampling rate, a 4 kHz bandwidth (case A), an 8 kHz bandwidth (case B) or a 12 kHz bandwidth (case C). The individual sampled values are represented as dots, with the different sampling rates being indicated by different time intervals between the sampled values on the time axis.

In the following reference is once again made to FIG. 1*b*. In order to generate the excitation signal exc, a fixed codebook SCB is also provided which is often also referred to as an innovative codebook. A specific entry from the fixed codebook SCB is selected by means of a reference idx_s to the fixed codebook SCB. Said entry is amplified by means of a suitable gain factor g_s. The signal resulting therefrom forms the fixed excitation signal exc_s.

In order to obtain a bandwidth-expanded fixed excitation signal exc_s, values are optionally inserted between the existing values in the fixed codebook. The number of values inserted therebetween depends on the desired bandwidth expansion. Said insertion is intended to be made clear by means of the entry int N.

FIG. 3 shows the history (history ACB) recorded in the adaptive codebook ACB, as well as a current time frame (actual frame). The respective current frame is shown on the one hand to the right of the dashed line, by means of which the continuous time is to be expressed on a time axis (t) to the right. For better visibility the frame is shown on the other hand above the sampled values and intermediate values present in the adaptive codebook.

Sampled value is the term used to denote the values sampled in an original first sampling frequency. The values initially synthetically inserted therebetween are referred to as intermediate values, which initially assume the value 0 and then values≠0 as a function of the respective new time frames of the signal. In line a), positions at which sampled values are provided in the original smaller bandwidth are circled, while the values lying between are intermediate values.

For the first frame (frame 1), the adaptive codebook ACB is empty, i.e. only zero values are present at the times which correspond to a desired sampling rate. At the same time zeros are already inserted as intermediate values, with the result that in line a) in the adaptive codebook zero values are present at the times which already correspond to a higher sampling rate.

If the first frame is present for example only in a first sampling rate, for example 4 kHz, as for instance by means of the non-zero values of the current frame in line a, and if, however, a subsequent encoding for a tripled sampling rate, for example 12 kHz, is to be performed, a corresponding number of zero values is inserted between the existing sampled values. This is also shown in line a for the current frame.

If, for example, the rate is expanded to the tripled sampling rate, which then corresponds to a tripled bandwidth of the signal achievable thereby, then 3 minus 1 intermediate values are inserted between existing sampled values. For the second frame (frame 2), the first frame is already contained in the adaptive codebook. Using an index by means of which each of the sampling points and intermediate values can be selected, a suitable segment is selected from the adaptive codebook. The adaptive codebook ACB contains a number of M1 values, where M1=M0*M3 if M0 represents the number of values present for the first sampling rate, i.e., for example, at 4 kHz. With regard to the lower first sampling rate (of, for example, 4 kHz) against the intermediate values lying between the original sampled values in the case of non-integer basic voice frequency parameters p.

The second frame is represented for example by the elliptically circled segment from the adaptive codebook ACB.

For the third time frame (line D), which is represented by the elliptically circled segment from the adaptive codebook ACB, intermediate values≠0 are present in the adaptive codebook ACB. An adaptive codebook is built up successively in the manner shown.

The invention claimed is:

1. A method for encoding an analog signal subdivided into time frames and to which a synthetic signal is matched, comprising:

using a communication terminal device to encode an analog signal by breaking down the analog signal into time frames and synthetically producing a synthetic signal to match the analog signal time frame by time frame via a synthesis filter, the communication terminal device having at least one adaptive codebook that contains a plurality of sample values, the sample values being comprised of at least one excitation signal from earlier time frames;

exciting the synthesis filter via an excitation signal, the excitation signal formed by the communication terminal device performing an excitation signal generation method comprising:

selecting a segment corresponding to a length of a current time frame from a plurality of the sampled values contained in the at least one adaptive codebook using a reference parameter dependent on a basic voice frequency that assumes non-integer values that identify locations for intermediate values positioned between the sampled values, choosing intermediate values corresponding to the sampled values, and using all the sampled values and all the intermediate values for forming the excitation signal.

2. The method as claimed in claim 1, wherein a fixed codebook is additionally used for forming the excitation signal.

3. The method as claimed in claim 1, wherein the reference parameter is represented as a fraction of a whole number and wherein a time interval between sampled values and intermediate values is also reduced by the number.

4. The method as claimed in claim 3, wherein a fixed codebook is additionally used for forming the excitation signal.

5. The method as claimed in claim 4, wherein intermediate values for an entry in the fixed codebook are generated by a time shifting of the fixed codebook entry.

6. The method as claimed in claim 4, wherein intermediate values are generated via an interpolation of signal components of an entry in the fixed codebook.

7. The method as claimed in claim 1, wherein a white noise signal is additionally used for forming the excitation signal.

8. The method as claimed in claim 7, wherein the white noise signal is recorded from the environment or generated by a noise generator.

9. The method as claimed in claim 1, wherein the intermediate values are formed via an interpolation of the already existing sampled values.

10. The method as claimed in claim 1, wherein the excitation signal is filtered by a Wiener FIR filter.

11. A communication terminal having at least one adaptive codebook that contains a plurality of sample values, the sample values being comprised of at least one excitation signal from earlier time frames, the communication terminal comprising:

a synthesis filter excited via an excitation signal, the excitation signal formed via an excitation signal generation method comprising:

selecting a segment corresponding to a length of a current time frame from a plurality of the sampled values contained in the at least one adaptive codebook using a reference parameter dependent on a basic voice frequency that assumes non-integer values that identify locations for intermediate values positioned between the sampled values, choosing intermediate values corresponding to the sampled values, and using all the sampled values and all the intermediate values for forming the excitation signal; and wherein the communication terminal uses the synthesis filter to encode the analog signal.

12. A receiver having a receiving unit for receiving encoding parameters, comprising:

a receiver for receiving an encoded signal;

a computing unit configured for decoding the encoded signal, wherein the signal encoded via the method comprising:

using a communication terminal device to encode an analog signal by breaking down the analog signal into time frames and synthetically producing a synthetic signal to match the analog signal time frame by time frame via a synthesis filter, the communication terminal device having at least one adaptive codebook that contains a plurality of sample values, the sample values being comprised of at least one excitation signal from earlier time frames;

exciting the synthesis filter via an excitation signal, the excitation signal formed by the communication terminal device performing an excitation signal generation method comprising:

selecting a segment corresponding to a length of a current time frame from a plurality of the sampled values contained in the at least one adaptive codebook using a reference parameter dependent on a basic voice frequency that assumes non-integer values that identify locations for intermediate values positioned between the sampled values, choosing intermediate values corresponding to the sampled values, and using all the sampled values and all the intermediate values for forming the excitation signal.

* * * * *